US008079941B2

(12) United States Patent
Nortje

(10) Patent No.: US 8,079,941 B2
(45) Date of Patent: Dec. 20, 2011

(54) EXERCISING APPARATUS

(76) Inventor: Andre Nortje, Sydney (AU)

( * ) Notice: Subject to any disclaimer, the term of this patent is extended or adjusted under 35 U.S.C. 154(b) by 0 days.

(21) Appl. No.: 12/534,097

(22) Filed: Jul. 31, 2009

(65) Prior Publication Data

US 2011/0028286 A1 Feb. 3, 2011

(51) Int. Cl.
*A63B 21/015* (2006.01)

(52) U.S. Cl. ..... 482/115; 482/96; 482/147

(58) Field of Classification Search ..... 482/96, 482/147, 127–139, 114–120
See application file for complete search history.

(56) References Cited

U.S. PATENT DOCUMENTS 2,126,443 A * 8/1938 Begley ..... 482/117
2,797,685 A * 7/1957 Packwood ..... 601/131
2,941,219 A * 6/1960 Irving ..... 441/56
3,110,047 A * 11/1963 Bringman ..... 441/67
3,785,642 A * 1/1974 Sterlicchi ..... 482/51
3,889,308 A * 6/1975 Persson ..... 441/56
4,126,326 A * 11/1978 Phillips ..... 280/205
4,344,615 A * 8/1982 Carlson ..... 482/46
4,717,147 A * 1/1988 Rochelle ..... 482/93
5,013,034 A * 5/1991 March et al. ..... 482/115
5,114,371 A * 5/1992 Alonzo ..... 441/129
5,222,929 A * 6/1993 Duda ..... 482/110
5,242,348 A * 9/1993 Bates ..... 482/105
5,330,407 A * 7/1994 Skinner ..... 482/117
5,728,031 A * 3/1998 Honeycutt ..... 482/83
5,755,526 A * 5/1998 Stanevich ..... 403/122
5,833,587 A * 11/1998 Strong et al. ..... 482/123
6,190,292 B1 * 2/2001 Panes ..... 482/93
6,234,703 B1 * 5/2001 Bieg et al. ..... 403/115
6,241,637 B1 * 6/2001 Basyuk ..... 482/44
6,309,331 B1 * 10/2001 Raymond ..... 482/148
6,409,413 B1 * 6/2002 Bieg et al. ..... 403/115
6,461,284 B1 * 10/2002 Francavilla ..... 482/142
6,547,703 B1 * 4/2003 Swezey et al. ..... 482/91
D476,705 S * 7/2003 Dillard ..... D21/662
6,652,421 B1 * 11/2003 Chen ..... 482/49
6,669,611 B2 * 12/2003 Raymond ..... 482/148
6,689,026 B2 * 2/2004 Almada ..... 482/140
6,730,005 B1 * 5/2004 Liao ..... 482/142
6,740,008 B1 * 5/2004 Ho et al. ..... 482/34
6,746,372 B2 * 6/2004 Hsu ..... 482/34
7,025,713 B2 * 4/2006 Dalebout et al. ..... 482/107
7,044,558 B2 * 5/2006 Chiu ..... 297/452.41
7,060,015 B2 * 6/2006 Acher ..... 482/142
7,118,517 B1 * 10/2006 Hale ..... 482/140
D536,542 S * 2/2007 Chiu ..... D6/352
7,285,080 B1 * 10/2007 Chiu ..... 482/142
7,311,644 B2 * 12/2007 Hale ..... 482/142
7,341,548 B2 * 3/2008 Heitzman et al. ..... 482/142
7,476,189 B2 * 1/2009 Hale ..... 482/142
7,575,540 B1 * 8/2009 Dobrow et al. ..... 482/142
7,604,581 B1 * 10/2009 Williams ..... 482/140
7,674,216 B1 * 3/2010 Bolling ..... 482/142
2002/0019300 A1 * 2/2002 Raymond ..... 482/148
2003/0022770 A1 * 1/2003 Lee ..... 482/136

(Continued)

*Primary Examiner* — Glenn Richman
(74) *Attorney, Agent, or Firm* — David N. Lathrop

(57) ABSTRACT

The present invention relates to an exercising apparatus including a rotatable ball, a handlebar, first and second clutches and a tension adjustor. The rotatable ball has an external surface. The handlebar passes through the ball and has two ends extending outwardly from the surface of the ball to provide handle grips. The first and second clutches support the ball. The tension adjustor is connected to the clutches.

23 Claims, 6 Drawing Sheets

U.S. PATENT DOCUMENTS

2003/0036467 A1* 2/2003 Almada ..... 482/140
2003/0125174 A1* 7/2003 Lin ..... 482/148
2003/0195098 A1* 10/2003 Hsu ..... 482/148
2004/0110609 A1* 6/2004 Huang ..... 482/121
2004/0110613 A1* 6/2004 Huang ..... 482/142
2006/0019807 A1* 1/2006 Husted et al. ..... 482/128
2007/0010377 A1* 1/2007 Wu et al. ..... 482/61
2007/0184941 A1* 8/2007 Krietzman ..... 482/93

* cited by examiner

EXERCISING APPARATUS

CROSS-REFERENCE TO RELATED APPLICATIONS

Not Applicable.

FEDERALLY SPONSORED RESEARCH

Not Applicable.

JOINT RESEARCH AGREEMENT

Not Applicable.

MATERIAL SUBMITTED ON A COMPACT DISC

Not Applicable.

BACKGROUND OF THE INVENTION

A. Field of the Invention

This invention relates to an exercising apparatus. More particularly, the invention relates to an exercising apparatus for cardiovascular or body building exercises.

B. Description of Related Art

Various exercising apparatus can be found in the market for fitness and body building purposes. Utilisation of these exercising apparatus however typically involve at least one of the following for the user to achieve the desired results:

1. addition or removal of weights;
2. demounting and mounting of the apparatus in order to add or remove weights;
3. provision and adjustment of straps or other fastening means.

As such, these exercising apparatus are cumbersome and fiddly to handle. It is an object of this invention to provide an exercising apparatus which involves easy and simple adjustments to enable a user to perform a wide range of strength and cardiovascular exercises.

BRIEF SUMMARY OF THE INVENTION

According to the present invention there is provided an exercising apparatus including:

a rotatable ball having an external surface;

a handlebar passing through the ball and having two ends extending outwardly from the surface of the ball to provide handle grips;

first and second clutches supporting the ball; and a tension adjustor connected to the clutches.

DETAILED DESCRIPTION OF THE INVENTION

Figure 1:
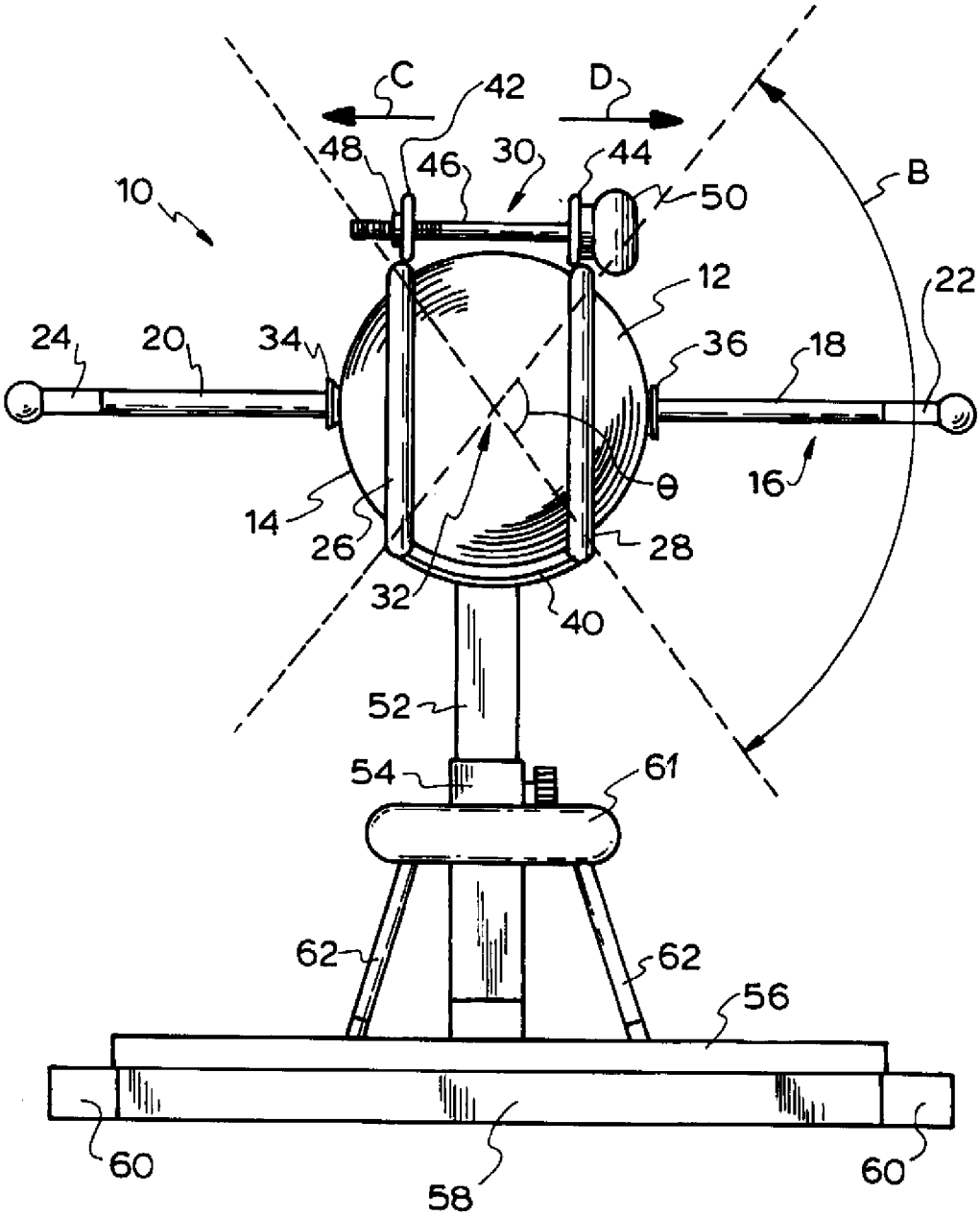
FIG. 1 is a front view of an exercising apparatus in accordance with the present invention.

Referring to FIG. 1, an exercising apparatus 10 includes a rotatable ball 12, a handlebar 16, two clutches 26 and 28, and a tension adjustor 30.

Figure 2:
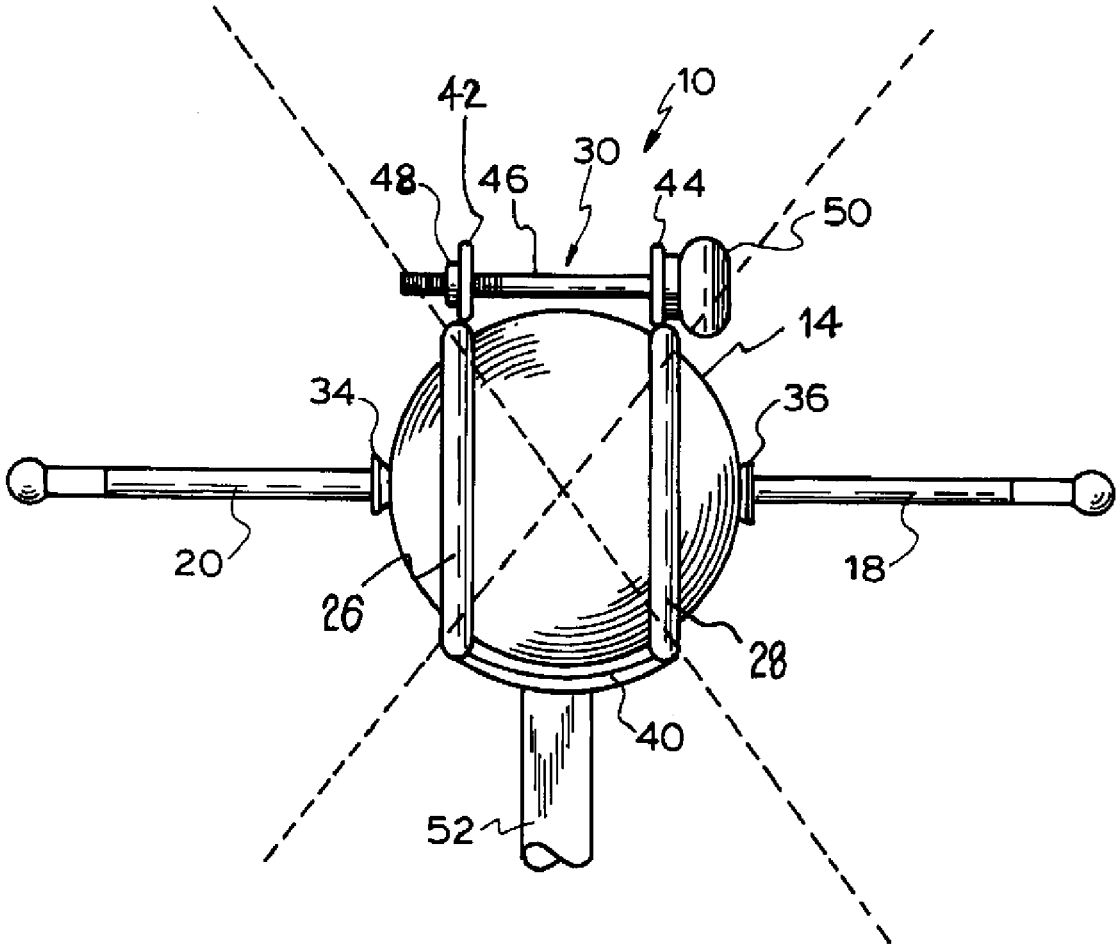
FIG. 2 is a partial front view of the exercising apparatus of FIG. 1 showing a pair of clutches mounted on a ball with a handle bar.
Figure 3:
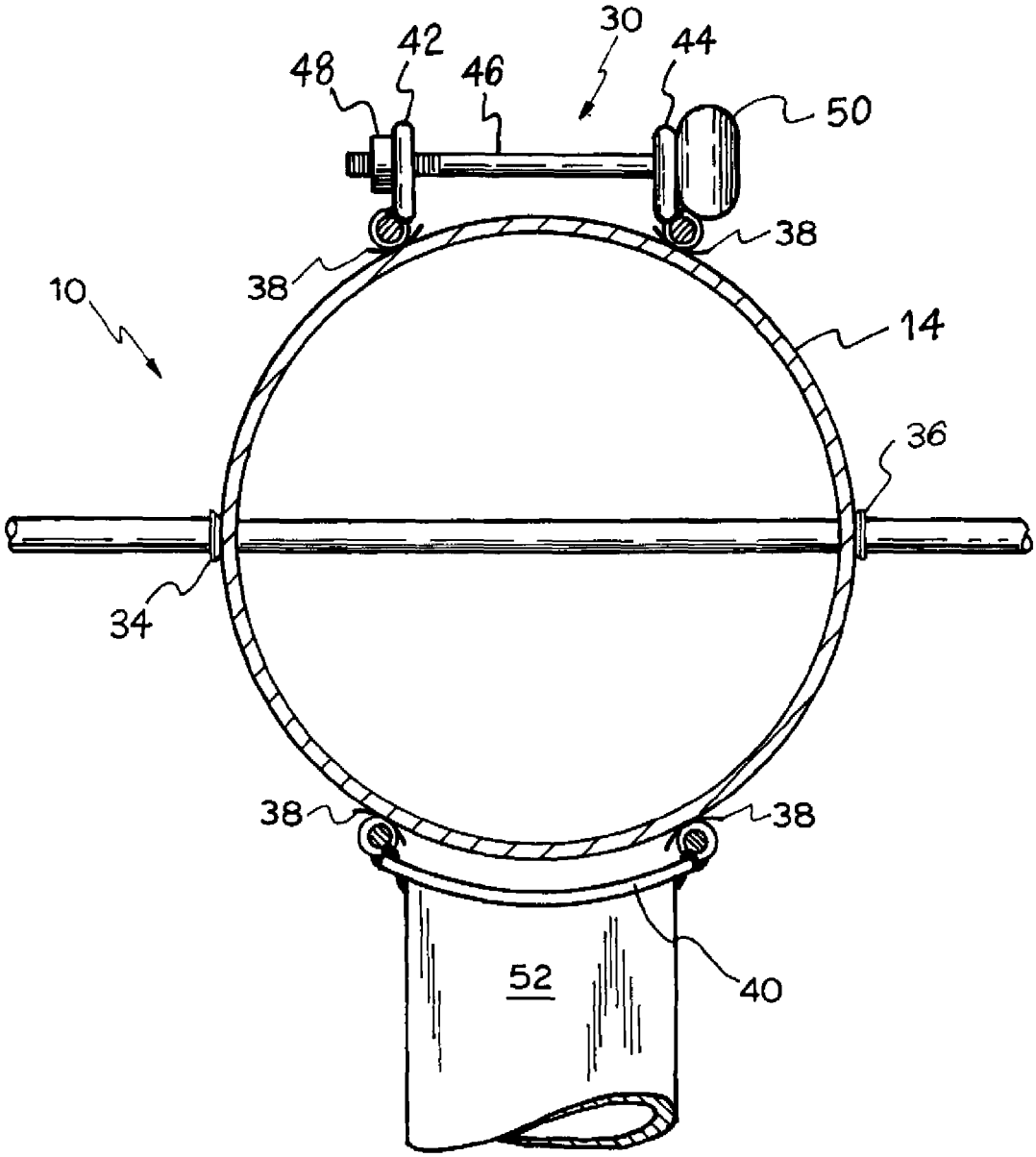
FIG. 3 is a cross-sectional view taken along line E-E shown in FIG. 4.
Figure 4:
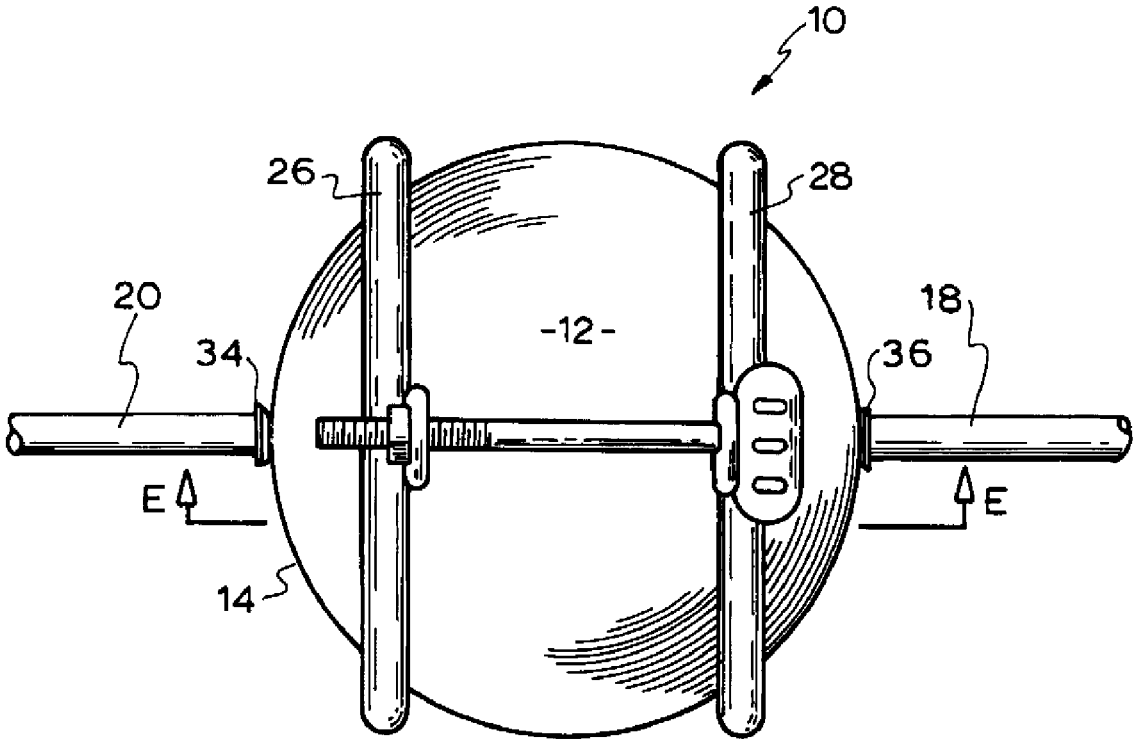
FIG. 4 is a plan view of the ball supported by the clutches of the exercising apparatus of FIG. 1.

Referring to FIGS. 1, 2 and 4, the rotatable ball 12 is a sphere with an external curved surface 14. As best shown in FIG. 3, the handlebar 16 passes through the ball 12 and has two ends 18 and 20 extending outwardly from the surface 14 of the ball 12 to provide handle grips 22 and 24.

Turning to FIGS. 3 and 4, each of the clutches 26 and 28 is in the form of a ring encircling and supporting the ball 12. Each of the clutches 26 and 28 is connected to a flexible adaptor plate 40. The adaptor plate 40 functions as a bridging means maintaining both clutches 26 and 28 at desired positions. As best shown in FIG. 3, the ball 12 is not fixed to the clutches 26 and 28. Hence the ball 12 is capable of making multi-directional rotational movement with respect to the clutches 26 and 28.

Referring to FIGS. 1 to 4, the handlebar 16 passes through the centre 32 of the ball 12 and extends outwardly from the surface 14 of the ball 12. The handlebar 16 includes two cir-clips 34 and 36 provided at the two ends of the handlebar 16, respectively. Each cir-clip 34, 36 abuts the surface 14 of the ball 12 so as to maintain the handlebar 16 in a fixed position with respect to the ball 12.

Figure 5:
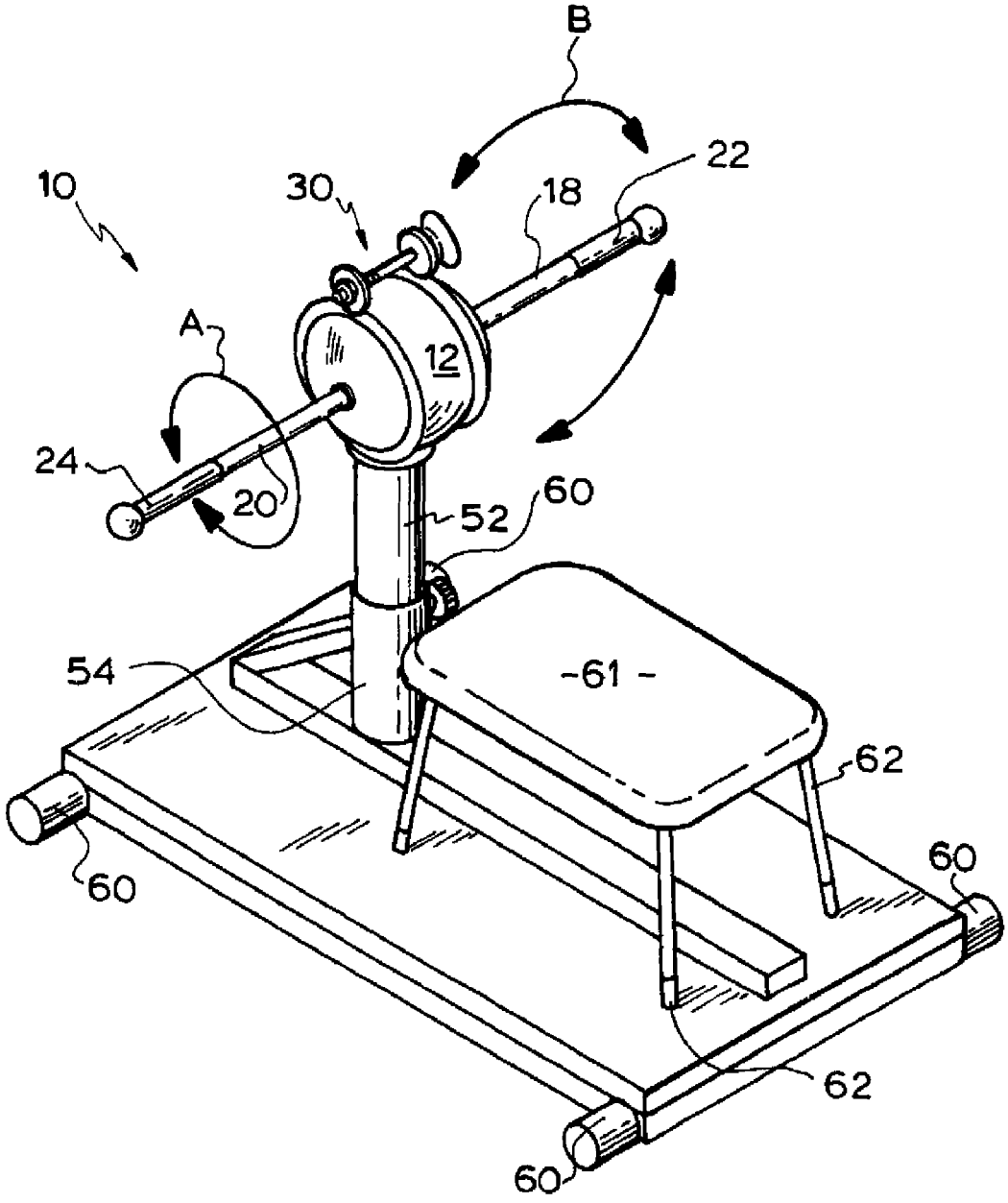
FIG. 5 is a perspective view of the exercising apparatus of FIG. 1.
Figure 6:
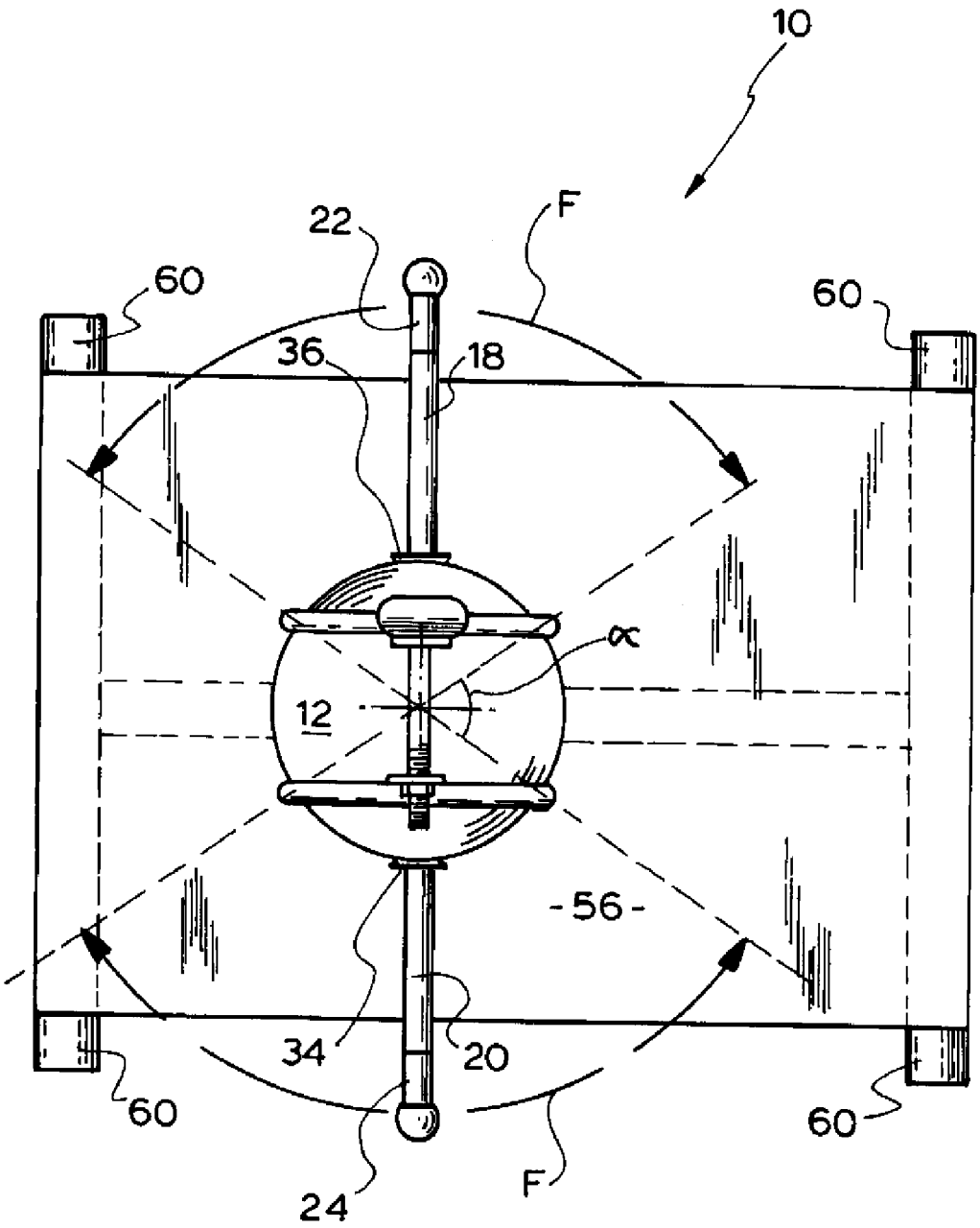
FIG. 6 is a plan view of the exercising apparatus of FIG. 1 including a platform.

In operation, the handlebar 16 is used to effect multi-directional movement of the ball 12. Referring to FIGS. 5 and 6, for example, the handlebar is capable of being moved back and forth (as indicated by arrow F in FIG. 6) between angle $\alpha$ (see FIG. 6), up and down (as indicated by arrow B in FIG. 5) between angle $\Theta$ (see FIG. 1), and in an orbit clockwise or anticlockwise (as indicated by arrow A in FIG. 5). It will be appreciated that the ball is capable of being rotated in any directions in addition to those illustrated and described herein.

As best shown in FIG. 3, each clutch 34, 36 is clad with thick cotton cloth 38. The two clutches 26 and 28 are spaced apart and configured to make contact with the surface 14 of the ball 12. In use, the ball 12 experiences resistance when rotating due to friction between the cotton cloth 38 and the surface 14 of the ball 12.

Referring to FIGS. 1 to 6, the tension adjustor 30 is connected to the clutches 26 and 28. The tension adjustor 30 involves an adjusting mechanism for biasing the clutches 26 and 28 towards one another. The tension adjustor 30 operates in conjunction with the plates 42 and 44 which are welded to the clutches 26 and 28, respectively. The tension adjustor 30 includes a threaded bolt 46 and a nut 48. The threaded bolt 46 has one end encased in a knob 50 which abuts the plate 44. The nut 48 is internally threaded and welded to the plate 42. With such an arrangement, turning of the knob 50 by the user causes displacement of the clutch 26 in a forward or reverse direction, as indicated by arrows C and D in FIG. 1. In fact, clutch 28 may also move leaning towards clutch 26 as a result of turning of the knob 50. This results in the clutches 26 and 28 being drawn closer to one another in biased positions or forced apart in neutral positions. When the clutches 26 and 28 are in the biased positions, a larger resistance will be experienced by the user when rotating the ball 12 with the handlebar 16. Conversely, when the clutches 26 and 28 are in the neutral positions, the resistance will be relatively lower.

As best shown in FIGS. 1 and 5, the exercising apparatus 10 has an anchoring pillar 52 having one end affixed to the underside of the flexible adaptor plate 40 and another end connected to a steel pipe frame 54. The steel pipe frame 54 is mounted on a platform 56 which in turn rests on a base 58. The base 58 has extensions covered by plastic pipe plugs 60.

It is intended that the exercising apparatus 10 is anchored to the floor by the weight of the user who can stand on the platform 56 or sit on a bench 61 which is movably rested on the platform 56.

The exercising apparatus of the present invention may offer at least the following advantages:

1. it enables the user to exercise different parts of the upper body in training;
2. it is easy to use and adjust for achieving different desired training results;
3. the ball capable of rotating multi-directionally facilitates a vast number of exercise options and orientations; and
4. it solves the problem of limited muscle training and enables targeted muscle training.

The invention claimed is:

1. An exercising apparatus comprising:

a rotatable ball having an external surface;

a handlebar passing through the ball and having two ends extending outwardly from the surface of the ball to provide handle grips;

first and second clutches, wherein each clutch encircles the ball and the first and second clutches collectively support the ball; and a tension adjustor connected to the clutches.

2. The exercising apparatus of claim 1, wherein the ball is spherical.

3. The exercising apparatus of claim 1, wherein the ball is not fixed to the clutches such that the ball is capable of making multi-directional rotational movement.

4. The exercising apparatus of claim 1, wherein the handlebar passes through the center of the ball.

5. The exercising apparatus of claim 1, wherein the ball is movable in multiple directions.

6. The exercising apparatus of claim 1, wherein the handlebar is movable back and forth, up and down, and in an orbit clockwise or anticlockwise.

7. The exercising apparatus of claim 1, wherein each clutch is clad with cotton cloth.

8. The exercising apparatus of claim 1, wherein the two clutches are spaced apart and configured to make contact with the surface of the ball.

9. The exercising apparatus of claim 1, wherein the tension adjustor involves an adjusting mechanism for biasing the clutches towards one another.

10. The exercising apparatus of claim 1, wherein the tension adjustor operates in conjunction with first and second plates which are welded to the first and second clutches, respectively.

11. The exercising apparatus of claim 10, wherein the tension adjustor includes a threaded bolt and a nut.

12. The exercising apparatus of claim 11, wherein the threaded bolt has one end encased in a knob that abuts the first plate.

13. The exercising apparatus of claim 11, wherein the nut is internally threaded and welded to the second plate.

14. The exercising apparatus of claim 12, wherein turning of the knob causes displacement of at least one of the clutches in a forward or reverse direction.

15. The exercising apparatus of claim 12, wherein turning of the knob draws the clutches closer to one another in biased positions or forces the clutches apart in neutral positions.

16. The exercising apparatus of claim 14, wherein when the clutches are in the biased positions, a larger resistance is experienced in rotating the ball whereas when the clutches are in the neutral positions, the resistance is relatively lower.

17. The exercising apparatus of claim 1, which includes an anchoring pillar.

18. The exercising apparatus of claim 17 wherein the anchoring pillar has one end affixed to a flexible adaptor plate and another end connected to a steel pipe frame.

19. The exercising apparatus of claim 18, wherein the steel pipe frame is mounted on a platform.

20. The exercising apparatus of claim 19, wherein the platform rests on a base having extensions covered by plastic pipe plugs.

21. The exercising apparatus of claim 19, wherein the platform is for supporting a user standing on the platform.

22. The exercising apparatus of claim 19 that comprises a bench for supporting a user sitting on the bench.

23. The exercising apparatus of claim 21, wherein the bench movably rests on the platform.

* * * * *